US005485884A

United States Patent [19]

Hanley et al.

[11] Patent Number: 5,485,884

[45] Date of Patent: Jan. 23, 1996

[54] HYDRIDE OPERATED REVERSIBLE TEMPERATURE RESPONSIVE ACTUATOR AND DEVICE

[75] Inventors: David J. Hanley, Bergenfield, N.J.; E. Lee Huston, Tuxedo; P. Mark Golben, Florida, both of N.Y.

[73] Assignee: Ergenics, Inc., Ringwood, N.J.

[21] Appl. No.: 658,427

[22] Filed: Feb. 20, 1991

Related U.S. Application Data

[63] Continuation of Ser. No. 371,092, Jun. 26, 1989, abandoned.

[51] Int. Cl.[6] ..... A62C 35/08

[52] U.S. Cl. ..... 169/19; 169/37; 169/56; 169/90; 169/DIG. 3; 137/79; 251/11; 206/0.7

[58] Field of Search ..... 169/90, 19, 56, 169/60, 61, 26, 37, 65, DIG. 3; 137/79; 251/11, 96, 113, 111, 50; 340/592, 584; 222/54; 62/46.2; 34/15; 206/0.7

[56] References Cited

U.S. PATENT DOCUMENTS

| | | | |
|---|---|---|---|
| 615,262 | 12/1868 | Dinsmore | 169/37 |
| 1,233,289 | 7/1917 | Thomson | 169/26 |
| 3,196,423 | 7/1965 | Lindberg | 340/592 X |
| 3,277,860 | 10/1966 | Lindberg, Jr. | 340/592 X |
| 3,464,497 | 9/1969 | Globerman et al. | 169/60 |
| 3,653,443 | 4/1972 | Dockery | 169/65 X |
| 3,877,527 | 4/1975 | Johnson | 169/90 |
| 4,282,931 | 8/1981 | Golben | 169/26 X |
| 4,346,558 | 8/1982 | Bernett | 169/37 X |
| 4,377,209 | 3/1983 | Golben | 169/60 X |
| 4,396,114 | 8/1983 | Golben et al. | 34/15 X |
| 4,457,136 | 7/1984 | Nishizaki et al. | 62/46.2 |
| 4,819,717 | 4/1989 | Ishikawa et al. | 206/0.7 X |

FOREIGN PATENT DOCUMENTS

| | | | |
|---|---|---|---|
| 474658 | 3/1974 | Australia | 169/90 |
| 1227207 | 4/1986 | U.S.S.R. | 169/90 |
| 984268 | 2/1965 | United Kingdom | 251/11 |

OTHER PUBLICATIONS

"Active Control Devices Metal–Hydrogen Systems", J. M. Welter, Journal of the Less–Common Metals, vol. 104, 1984, pp. 251–257.

German Article–"Thermostatisches Expansionsventil mit Hydridfullung", J. M. Welter et al, Regelungstechnische Praxis, Heft 2, 1983, pp. 51–55.

*Primary Examiner*—David M. Mitchell
*Assistant Examiner*—Gary C. Hoge
*Attorney, Agent, or Firm*—Dorn, McEachran, Jambor & Keating; Vangelis Economou

[57] ABSTRACT

An actuator for performing a function at a predetermined temperature includes an actuator assembly with a resiliently expandable element and a device for liberating hydrogen gas into a sealed system formed in part by the element. When the hydrogen gas pressure in the system becomes sufficiently high, the element expands to perform the function. The resiliently expandable element is a piston or a bellows and the device for liberating hydrogen gas is a hydride sensor assembly.

2 Claims, 4 Drawing Sheets

HYDRIDE OPERATED REVERSIBLE TEMPERATURE RESPONSIVE ACTUATOR AND DEVICE

This is a continuation of applications Ser. No. 07/371,092 filed on Jun. 26, 1989 now abandoned.

BACKGROUND OF THE INVENTION

FIELD OF THE INVENTION

This invention relates to a temperature responsive actuator for performing a desired function, such as activating a sprinkler head valve when ambient temperature reaches a predetermined value, also to a novel and improved device for storing, releasing and recovering hydrogen. More particularly, the invention relates to such a temperature responsive actuator making use of a hydride sensor assembly and an actuator assembly wherein when the ambient temperature reaches the predetermined value, hydrogen gas is liberated reversibly from a hydride metal in the hydride sensor assembly and the liberated hydrogen is used to generate gas pressure in a piston or bellows of the actuator assembly which gas pressure, when it attains a certain value, will move the piston or expand the bellows to cause performance of a desired mechanical operation such as operation of the sprinkler head valve.

DESCRIPTION OF THE PRIOR ART

Golben U.S. Pat. 4,377,209 which issued on Mar. 22, 1983 disclosed use of a hydride sensor assembly as a heat sensor and actuator. The hydride sensor assembly of the '209 Patent was connected to a pressure side of an activating piston chamber. Upon reaching a predetermined temperature value, hydrogen gas was released into a chamber containing a piston, and when the gas pressure was sufficient it moved the piston against the force of a spring to cause a pin to pierce a membrane, thus freeing contents of a cartridge for use via an exit port. The piston was sealed by O-rings against the wall of the chamber. The '209 Patent involved destruction of a membrane when the device was actuated.

Earlier Golben U.S. Pat. No. 4,282,931 which issued on Aug. 11, 1981 had described an actuator with a sealed metal bellows. A metal hydride was contained inside the bellows and hydrogen gas was released therefrom by electrical heating. Such a design is obviously not suitable for fast response to ambient air temperature changes.

The teaching of Golben et al. U.S. Pat. No. 4,396,114, which issued on Aug. 2, 1983, also should here be noted. In the '114 Patent a flexible hydrogen storage system employed an axial spring to confine the hydride against an outside wall of a storage system for fast heat transfer. However, available wire sizes limited the radius of curvature of the storage system to approximately 15 cm (6 inches). Sharper bends resulted in the spring opening sufficiently for hydride particles to enter the interior.

OBJECTS OF THE INVENTION

Accordingly, it is an important object of this invention to provide a temperature responsive actuator that overcomes the noted disadvantages of the prior art.

It is another important object of this invention to provide fast response time of approximately 8 seconds for a sprinkler head valve.

It is another important object of this invention to accommodate either piston or bellows operation of a hydride actuated sprinkler head valve.

It is another important object of this invention to provide a temperature responsive actuator that is simple in construction and reliable in operation, particularly as to temperature rating, generated pressure and sufficient piston or bellows displacement.

It is another important object of this invention to provide a temperature actuated fire sprinkler valve that takes up little ceiling height.

It is a further object of this invention to provide a temperature responsive actuator that is resettable, i.e., which, following actuation at a predetermined elevated temperature, when the temperature drops to normal once again, will automatically terminate the temperature related function and return to its original condition, without requiring replacement of any parts.

It is another important object of this invention to provide a temperature actuated fire sprinkler valve that has a built-in time delay for shutoff when the heat source is removed.

It is still another object of this invention to provide a novel and improved device for storing and recovering hydrogen.

The foregoing and other objects, features and advantages will appear more fully hereinafter.

SUMMARY OF THE INVENTION

An actuator embodying the invention performs a function at a predetermined elevated temperature and includes an actuator assembly with a resiliently expandable element and means for liberating hydrogen gas into a sealed system formed in part by the expandable element. When the hydrogen gas pressure in the system becomes sufficiently high, the element expands to perform the function. The expandable element is a piston or bellows and the hydrogen gas liberating means is a hydride sensor assembly. The actuator assembly also includes a housing having first and second ends, a base member having an external cylindrical surface and a circular surface terminating at one end thereof and located within the housing intermediate the first and second housing ends. In one embodiment the bellows surrounds the external cylindrical surface and has a closed end covering the circular surface and an open end secured to the base member in hydrogen gas sealing relationship therewith. A piston has a first end within the housing and confronting the closed bellows end and a second end adjacent the second housing end. A spring within the housing biases the piston toward the bellows, and the base member further includes a hydrogen gas passage having a first end and a second end in communication with the interior of the bellows. In another embodiment a piston, with O-ring or quad ring seals, operates within a cylinder and the bellows is eliminated. As will be understood by those skilled in the sprinkler art, the configuration and location of the housing, piston and biasing spring may be modified to facilitate coupling of the actuator to a device to be controlled.

The hydride sensor assembly includes an outer metallic tube containing flexible tubular means porous to passage of hydrogen gas therethrough and spaced from an inner wall thereof and providing a hydrogen gas passage therein, and hydriding alloy powder in an annular volume between the inner wall of the tube and the tubular means. The tube has a closed end and an open end in hydrogen gas sealed communication with the first end of the hydrogen gas passage of the base member.

When the temperature of the hydriding alloy powder is raised to a predetermined value, desorption of the hydriding alloy powder takes place, liberating hydrogen gas into the hydrogen gas passage within the sensor assembly and thence into the hydrogen gas passage in the base member and subjecting the piston and/or bellows to internal pressure which, upon attainment of a specific value, will cause the closed end of the bellows to move the piston against the resistance of the spring, to perform a temperature responsive function. Reducing the temperature of the hydriding alloy powder results in the reabsorption of the hydrogen gas and returns the assembly to its initial position.

Use of the actuator is disclosed in combination with a normally closed valve assembly having an inlet side and an outlet side, a water line for supplying water to the inlet side and a sprinkler head attached to the outlet side. A portion of the hydride sensor assembly tube is coiled and wrapped around the sprinkler head, and the piston is positioned to open the valve assembly at a predetermined sensor temperature, thus to activate the sprinkler head. The sprinkler is turned of and reset when the sensor temperature cools below the predetermined thermal value.

Many other uses are also possible for either normally open or closed valves, self-locking valves, manual reset valves, actuation with increasing or decreasing temperature, thermostats, regulators and remote sensors. Uses requiring fast response, large forces and noncondensable gases are especially favored.

DESCRIPTION OF THE INVENTION

Figure 2:
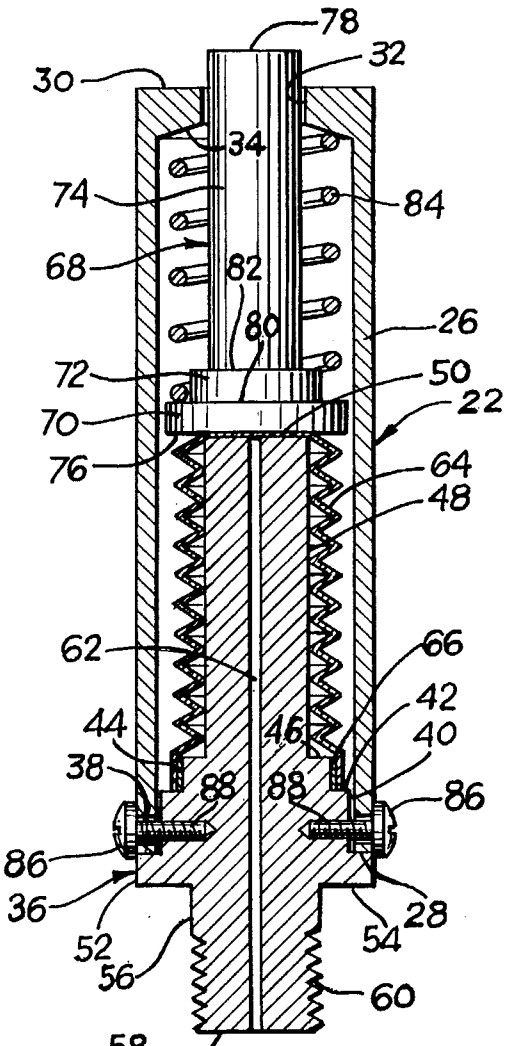
FIG. 2 is an axial sectional view of the actuator assembly of FIG. 1, taken on line 2—2 of FIG. 1.
Figure 1:
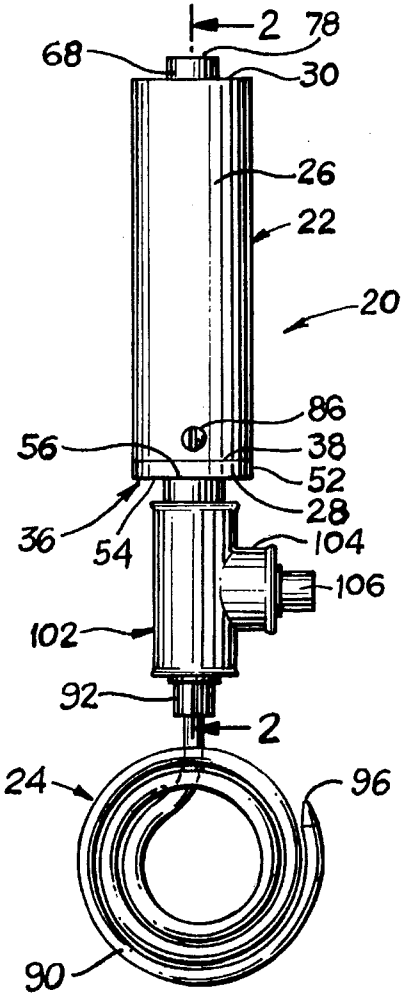
FIG. 1 is an elevational, partly schematic view of an actuator which shows one preferred embodiment of this invention, including an actuator assembly and a hydride sensor assembly.

FIG. 1 shows an idealized temperature responsive actuator 20 which includes an actuator assembly 22 and a hydride sensor assembly 24. Actuator assembly 22 also is shown in FIG. 2 and hydride sensor assembly 24 in FIGS. 3 and 4.

Actuator assembly 22 includes a cylindrical housing 26 about 2.55 inches (6.5 cm) in length, 0.75 (1.9 cm) in outside diameter with a wall thickness of about 0.0625 inch (0.16 cm) from a first end 28 to a location spaced about 0.125 inch (0.32 cm) from a second end 30, at which location the wall thickness is increased to about 0.1875 inch (0.48 cm), providing a cylindrical hole 32 about 0.375 inch (0.95 cm) in diameter and providing a frustoconical internal flange surface 34 facing away from end 30. Housing 26 may be of suitable metallic material, such as brass.

Actuator assembly 22 also includes a cylindrical brass base member 36 that is assembled with housing 26. Base member 36 has an annular surface 38 perpendicular to the axis of member 36 and abutting end 28 of housing 26, an external cylindrical surface 40 about 0.59 inch (1.51 cm) in diameter and 0.1875 inch (0.48 cm) in axial extent. The end of surface 40 remote from surface 38 is terminated by an annular surface 42 perpendicular to the axis of member 36 and facing in the same direction as annular surface 38. A cylindrical surface 44 about 0.5 inch (1.3 cm) in diameter upstands from the inner periphery of surface 42 and is about 0.1875 inch (0.48 cm) in axial extent. The end of surface 44 remote from surface 42 is terminated by an annular surface 46 perpendicular to the axis of member 36 and facing the same direction as annular surfaces 38 and 42. An external cylindrical surface 48 about 0.344 inch (0.87 cm) in diameter upstands from the inner periphery of surface 46 and is about 1.0625 inches (2.70 cm) in axial extent. The axial end of surface 48 remote from surface 46 terminates in a circular end surface 50 perpendicular to the axis of member 36 and providing an end of member 36.

Member 36 also has a cylindrical surface 52 depending from the outer periphery of annular surface 38 and having a diameter of about 0.75 inch (1.9 cm) and about 0.094 inch (0.24 cm) in axial length. The axial end of surface 52 remote from surface 38 is terminated by an annular surface 54 perpendicular to the axis of member 36 and facing in the direction opposite that faced by surface 38. Depending from the inner periphery of surface 54 is a cylindrical surface 56 coaxial with member 36 and about 0.406 inch (1.03 cm) in diameter. Member 36 continues on to a circular surface 58 perpendicular to the axis of member 36 and providing another end of member 36. Surface 58 is located about 0.50 inch (1.27 cm) from surface 54 and member 36 is provided with 0.375 inch (0.95 cm) diameter external pipe threads 60 extending from surface 58 toward surface 54.

Member 36 is provided with an axial hole 62 about 0.039 inch (0.10 cm) in diameter, produced by a #60 drill, extending from surface 50 to surface 58, and in open communication with both such surfaces. Hole 62 provides base member 36 with a hydrogen gas passage.

Actuator assembly 22 further includes a closed end flexible metal bellows 64, which in a satisfactory embodiment of the invention is a Cliflex brass bellows of 0.531 inch (1.35 cm) outside diameter. Bellows 64 is assembled onto base member 36 with the closed end of bellows 64 covering circular end surface 50 of base member 36 and the expandable body portion of bellows 64 surrounding cylindrical surface 48 of base member 36. The open end of bellows 64 surrounds cylindrical surface 44 and is soldered thereto as indicated at 66 to provide a hydrogen gas seal therewith, thus forming a subassembly of base member 36 and bellows 64.

Actuator assembly 22 also includes a brass piston 68 having a cylindrical base portion 70 surmounted by a cylindrical intermediate portion 72 in turn surmounted by a cylindrical shaft portion 74. Portions 70, 72 and 74 are coaxial, and portions 70 and 74 provide piston 68 with first and second circular ends 76 and 78, respectively. Portion 70 has a diameter of about 0.562 inch (1.43 cm) and an axial length of about 0.094 in (0.24 cm). Portion 72 has a diameter of about 0.406 inch (1.03 cm) and an axial length of about 0.094 inch (0.24 cm). Portion 74 has a diameter of about 0.3125 inch (0.79 cm) and an axial length of about 1.06 inch (2.70 cm). The axial length of piston 68 from end 76 to end 78 is about 1.25 inch (3.18 cm). The juncture of portions 70 and 72 provides an annular flange surface 80 facing away from end 76, and the juncture of portions 72 and 74 provides an annular flange surface 82 facing away from end 76.

Actuator assembly 22 further includes a coil spring 84 of wire 0.050 inch (0.13 cm) in diameter wound to a coil diameter of 0.525 inch (1.33 cm) and having an axial length when unstressed of about 1.55 inch (3.94 cm).

Actuator assembly 22 is completed by inserting spring 84 into first end 28 of housing 26, followed by piston 68, end 78 first, and then the sub-assembly of base member 36 and bellows 64, the closed end of bellows 64 first, until base member surface 38 abuts end 28 of housing 26, and securing these parts together by diametrically opposed screws 86 that are passed through holes in the wall of housing 26 and into threaded engagement with tapped holes 88 in surface 40 of base member 36. In the assembled condition, the closed end of bellows 64 engages end 76 of piston 68, and spring 84 is axially compressed between piston surface 80 and frusto-conical housing surface 34, with piston portion 72 within spring 84, and end 78 of piston 68 projecting beyond second end 30 of housing 26.

When bellows 64 is not internally pressurized by hydrogen gas, spring 84 maintains the closed end of bellows 64 against circular end surface 50 of base member 36 and piston end 78 projects about 0.125 inch (0.32 cm) beyond second housing end 30. In this condition, spring 84 produces a 20 pound (9.08 kg) force against the closed end of bellows 64. Bellows 64 has an effective area of about 0.214 square inch (1.38 $cm^2$) and a maximum rated pressure of 390 psig. A hydrogen gas pressure of 93.5 psig (20/0.214) is required to produce a force of 20 pounds (9.08 kg). For hydrogen gas pressure exceeding this value, the resistance of spring 84 will be overcome and movement of piston 68 will be initiated.

The configuration of base member 36 minimizes the volume enclosed between base member 36 and bellows 64, and base member 36 prevents bellows 64 from moving in compression. Housing 26 acts as a safety shield should bellows 64 become overpressurized for some reason.

Hydride sensor assembly 24 includes an outer copper refrigerator tube 90 having an outside diameter of 0.125 inch (0.32 cm), a wall thickness of 0.014 inch (0.036 cm) and a length of 12 inches (30.5 cm). Tube 90 passes through a drilled out 0.125 inch (0.32 cm) male pipe plug 92 having external threads 93. Tube 90 has an open end 94 that projects about 0.25 inch (0.64 cm) beyond plug 92. Tube 90 and plug 92 are soft soldered together. Tube 90 also has a closed end 96 where tube 90 is pinched closed and soft soldered to seal same.

Figure 4:
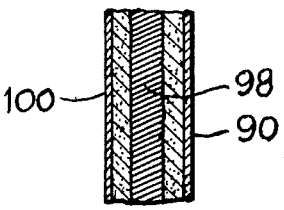
FIG. 4 is an enlarged fragmentary sectional view of the hydride sensor assembly taken on line 4—4 of FIG. 3.

As shown in FIG. 4, tube 90 contains flexible tubular means porous to the passage of hydrogen gas therethrough, illustrated in the form of a stainless steel garter spring 98 coaxial with tube 90. Spring 98 is about 12 inches (30.5 cm) long and has an outside diameter of about 0.065 inch (0.17 cm). One end of spring 98, plugged with a drop of high temperature silicone rubber (RTV) thereon, engages closed end 96 of tube 90. The other end of spring 98 is substantially flush with end 94 of tube 90.

The annular volume between the inner surface of tube 90 and spring 98 is filled with about 0.13 ounces (3.7 grams) of finely ground (−80 mesh) hydriding alloy powder 100 to a packing density of 2.68 ounces/$in^3$ (4.64 grams/$cm^3$), and the end of the annular volume at open end 94 of tube 90 is sealed with a bead of RTV. The fine hydriding alloy powder is produced most conveniently by hydride/dehydride grinding. When the actuator has been assembled and prior to use, powder 100 must be activated (hydrided). This activation can be accomplished in known fashion.

Spring 98 serves to provide a hydrogen gas passage therein and to position hydriding alloy powder 100 against the inner wall of tube 90.

The internal construction of hydride sensor assembly 24 as shown closely follows the teachings of the aforementioned Golben et al. '114 Patent.

The portion of tube 90 between pipe plug 92 and closed tube end 96 is coiled into a helix about 2 inches (5.08 cm) in diameter, and actuator assembly 22 and hydride sensor assembly 24 are joined by a 0.125 inch (0.69 cm) brass tee 102 (FIG. 1), threads 60 and 93 being screwed into tee 102. The joint with assembly 22 is soft soldered while the joint with assembly 24 is Teflon taped to permit replacement of assembly 24 should the need arise. Tee 102 has a tee branch 104 that is closed by a pipe plug 106 which is Teflon taped to permit access for hydride activation and pressure calibration, in known fashion. Both taped joints can be soft soldered for leak-free hydrogen service.

It is apparent that, with plug 106 in place, a closed hydrogen gas system is provided by tube 90, tee 102, hole 62 in base number 36 and the inside of bellows 64.

EXAMPLE 1

Figure 3:
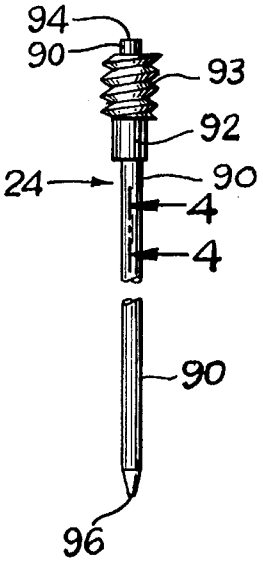
FIG. 3 is a broken view of the hydride sensor assembly of FIG. 1 in uncoiled condition.

Four hydride actuators were assembled according to FIGS. 1, 2 and 3. A Cliflex flexible metal bellows (17/32" OD, closed end, brass, 390 psig internal working pressure) was used. Approximately 4 grams of $LaNi_5$ powder was placed in the sensor tube. The reversible metal hydride former was activated in the usual manner. The sensor tube was then immersed in a 25° C. water bath and the hydrogen gas pressure equilibrated at 60 psia. The actuator was then sealed.

Two types of evaluation tests were performed on the hydride actuators. In the static tests, the sensor tube is immersed in the water bath and heated at a rate of 0.5° C./min. Bath temperature and piston displacement are monitored. Force developed by the actuator is determined by the displacement and the calibrated spring constant. A 30 lb force (corresponding to a 0.300" piston displacement) was obtained at 66° C. (151° F.).

Dynamic tests of the hydride actuators are obtained by plunging the sensor tube into a flowing (2.56 m/s; 8.3 ft/s) air stream at 135° C. (275° F.). Response time for a 0.300 inch displacement varied between 10.50 to 12.79 seconds in 30 tests (3 actuators, 10 tests each).

Figure 5:
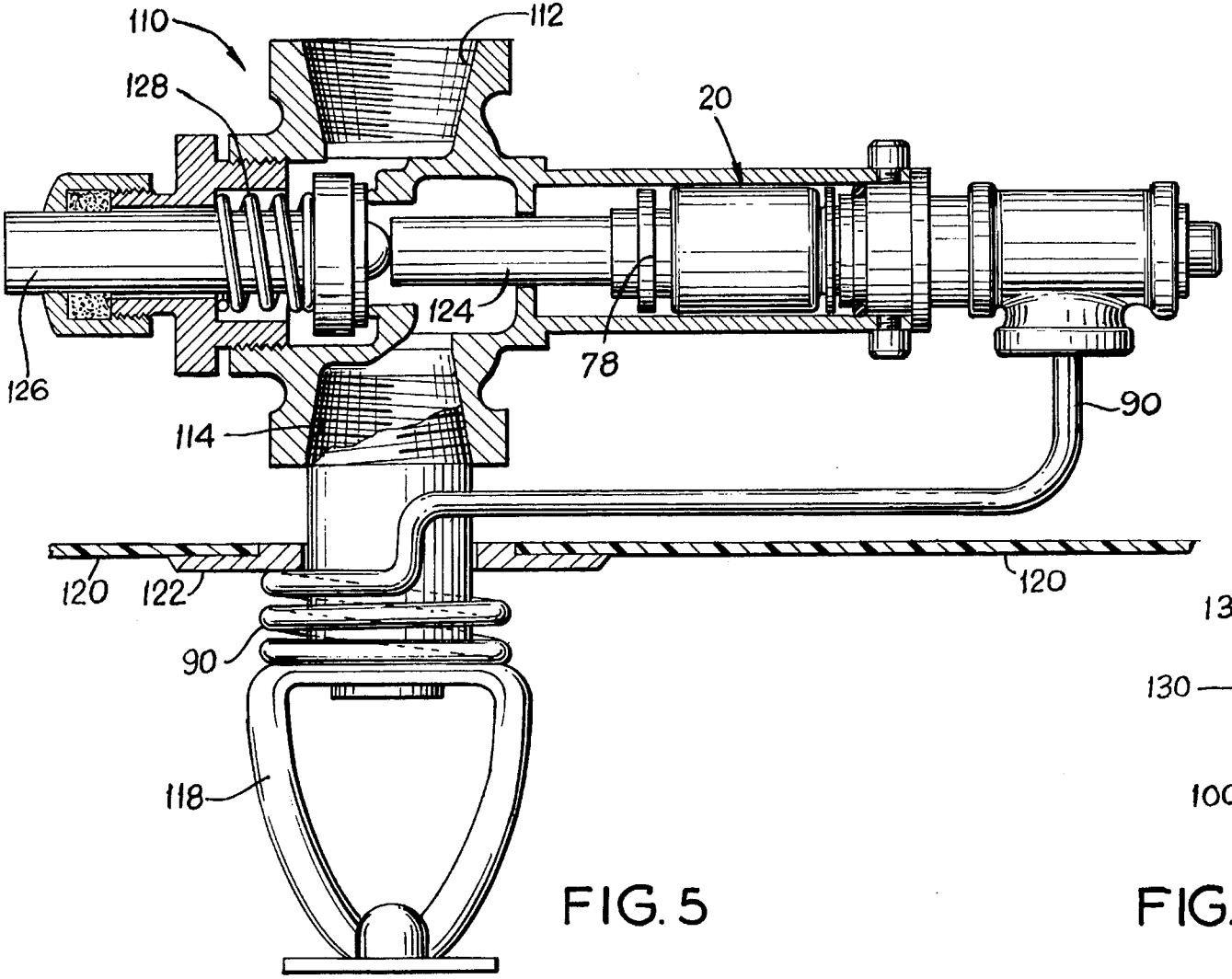
FIG. 5 shows the actuator of FIGS. 1, 2, 3 and 4, in a normally closed valve adapted as a sprinkler head assembly.

The force and response values obtained in Example 1 are suitable for the on-off actuation of a fire sprinkler. This is illustrated in FIG. 5 by adapting the hydride actuator to fit a ½ Globe valve. FIG. 5 shows hydride actuator 20 assembled with a normally closed valve assembly 110 having an inlet side 112 and an outlet side 114. A water line (not shown) supplies water to inlet side 112 and a sprinkler head 118 is attached to outlet side 114 of valve assembly 110. Valve assembly 110 and sprinkler head 118 are shown mounted respectively above and below a ceiling 120, through which tube 90 passes, and an escutcheon plate 122, tube 90 being wrapped around sprinkler head 118.

When the temperature of sprinkler head 118 and the portion of tube 90 wrapped therearound rises to a predetermined value, desorption of hydriding alloy 100 occurs and hydrogen gas is liberated in an endothermic reaction. When the hydrogen gas pressure attains a predetermined value, bellows 64 will expand axially, overcoming the resistance of spring 84 and moving piston end 78 further from second housing end 30. In a satisfactory example (Example 1) of the invention, this movement occurs when the hydrogen gas pressure exceeds 93.5 psig. A 0.1 inch (0.25 cm) travel of piston 68 is sufficient to open valve assembly 110 to permit water to flow therethrough from water line 116, thus activating sprinkler head 118. Upon subsequent cooling, absorption of hydriding alloy 100 occurs and it takes back the hydrogen gas in an exothermic reaction, reducing the hydrogen gas pressure and permitting spring 84 to return piston 68 and bellows 64 to the original positions shown in FIG. 2, and closing valve assembly 110. Piston end 78 bears against an axially movable member 124 which in turn bears against an additional axially movable member 126 which is biased by a spring 128 to be in a position in which it normally closes the water passage between inlet side 112 and outlet side 114 of valve assembly 110.

$LaNi_5$, the prototypical hydriding alloy, has pressure-temperature characteristics very close to the desired values, and it is assumed herein without limitation that the alloy used for hydriding alloy powder 100 is $LaNi_5$, possibly modified by small additions of Fe, Co, Al or Sn, to adjust temperature response.

Other changes can also be made, with similar effect. For example, if the stiffness of spring 84 is increased, the hydrogen gas pressure for actuation, and consequently the rated temperature, will increase. Alternatively or additionally, the diameter of bellows 64 may be decreased, with similar effect.

The internal volume (hydrogen volume) of the system has a pronounced effect on the quantity of hydride required and the actuator response time. The smaller the internal volume, the smaller the quantity of hydrogen gas required to produce a specified force. Less hydrogen gas means less hydride former required or alternatively a greater hydrogen reserve. Less hydrogen gas also means faster response time when the quantity of hydride and the heat transfer rate of the hydride are constant.

Figure 6:
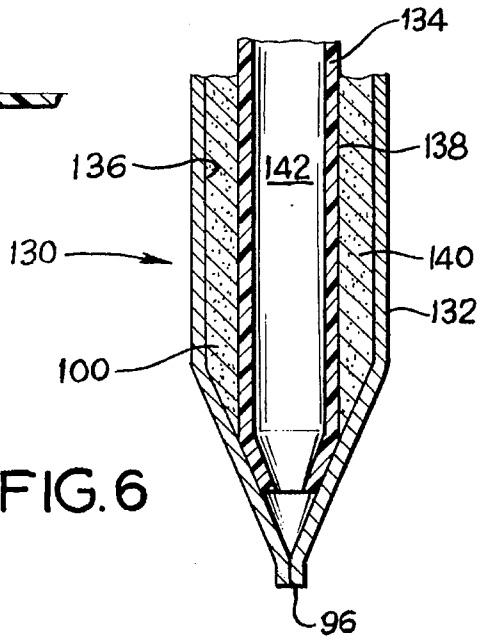
FIG. 6 is a fragmentary axial sectional view of a device for storing and recovering hydrogen.

FIG. 6 illustrates a device 130 for storing and recovering hydrogen. Device 130 comprises an outer tube 132 and an inner, nonmetallic tube 134 porous to the passage of hydrogen gas therethrough and disposed within outer tube 132. Outer tube 132 has an inner surface 136 and inner tube 134 has an outer surface 138, surfaces 136 and 138 confronting and spaced from each other to provide an annular volume therebetween. The annular volume contains hydriding alloy powder 100. The interior of inner tube 134 provides device 130 with a hydrogen gas passage 142. Outer tube 132 is bendable and is fabricated of heat conducting material such as copper and inner tube 134 is flexible, whereby device 130 can assume various configurations. Inner tube 134 is fabricated of thermoplastic material, of which polyethylene, polypropylene and Teflon are suitable examples. Tube 132 has a closed end 96 where tube 132 is pinched closed and soft soldered to seal same.

Inner tube 134 can be substituted in hydride sensor assembly 24 for stainless steel garter spring 98, with certain advantages. One such advantage is that device 130 can be bent to a much smaller coil diameter than is possible with garter spring 98. This advantage is achieved because with spring 98 there is a gap which increases with decreasing coil diameter, thus causing a problem as to retention of hydriding alloy powder. With tube 134, there is no such gap. Furthermore, the use of tube 134 results in a cost saving, in that tube 134 costs roughly only about ⅓ as much as an equal length of stainless steel garter spring 98. Additionally, the use of tube 134 facilitates fabrication because tube 134 does not need to be wrapped with any material such as is disclosed in the aforementioned Golben et al. '144 Patent.

EXAMPLE 2

Figure 7:
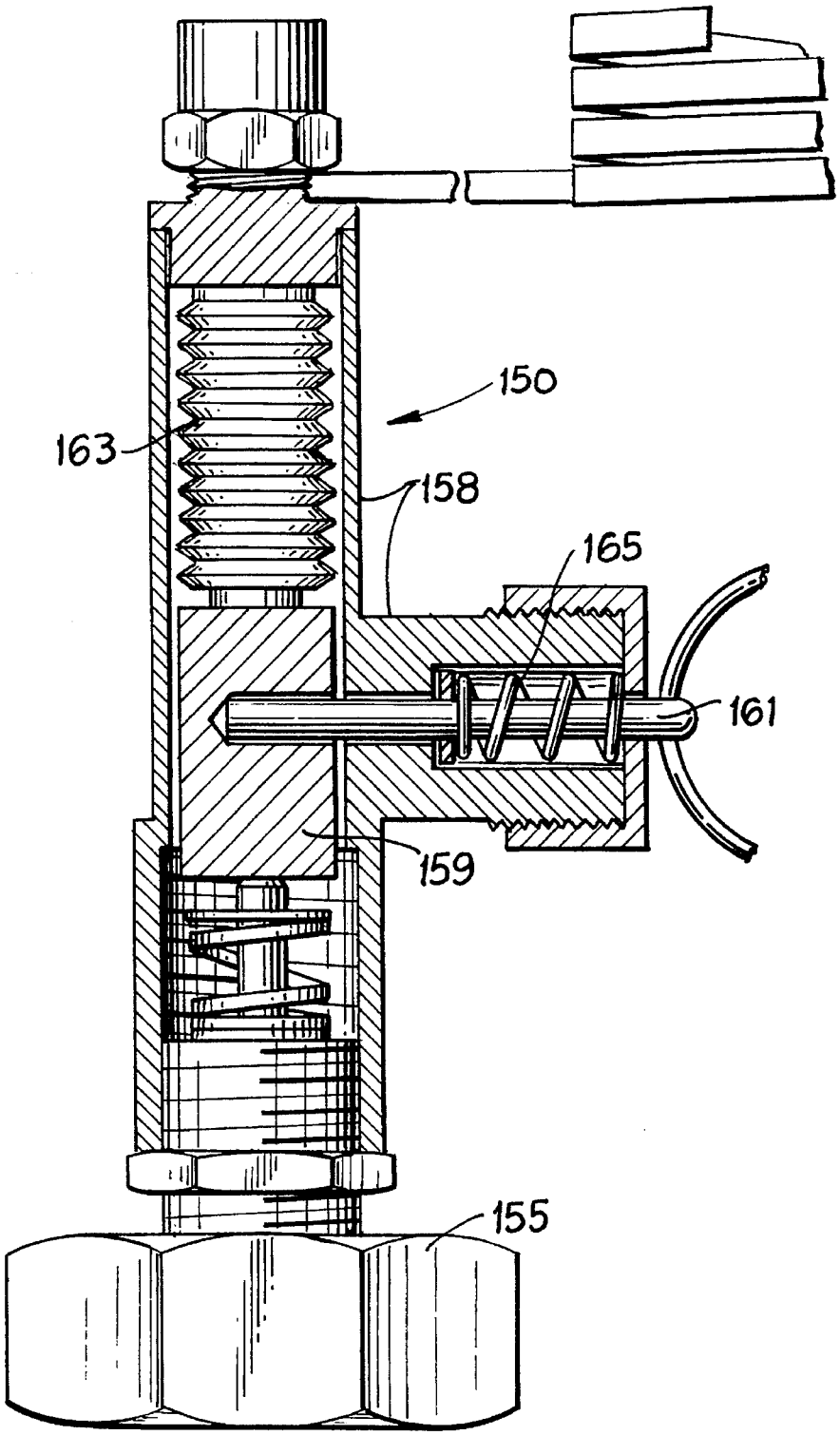
FIG. 7 is an enlarged fragmentary sectional view of a manual reset actuator with a locking mechanism.

A manual reset hydride sensor actuator 150 was fabricated as shown in FIG. 7. The function of this actuator is automatically to close a valve in response to an ambient air or process liquid temperature change. The details of the hydride sensor, base and expandable element are similar to those shown in FIGS. 2, 3 and 4. A Nupro B4-HK4 valve 155 was selected for actuation. The actuator housing 158 and piston 159 were modified to fit the valve and permit spring insertion of a lock pin 161 into the piston 159 at its closed position.

Closure is accomplished by expansion of a metal bellows 163 as hydrogen gas pressure increases in a hydride temperature sensor. The valve 155 is locked in the closed position by a spring 165 inserting a lock pin 161 into the piston 159. When the temperature of the hydride sensor returns to normal, the valve 155 can be reopened by manually removing the lock pin 161.

Tests were conducted with the actuator assembly shown in FIG. 7 connected to a 1000 psig helium line. Four grams of $LaNi_5$ were placed in the sensor tube. Ambient air temperatures ranged from 21° to 26° C. The actuator 150 closed in 4 seconds when the sensor coil was dipped into a 68° C. water bath. The actuator also closed in 4 seconds when sensor coil was heated with 135° C. air flowing at 8.3 feet per second.

EXAMPLE 3

Figure 8:
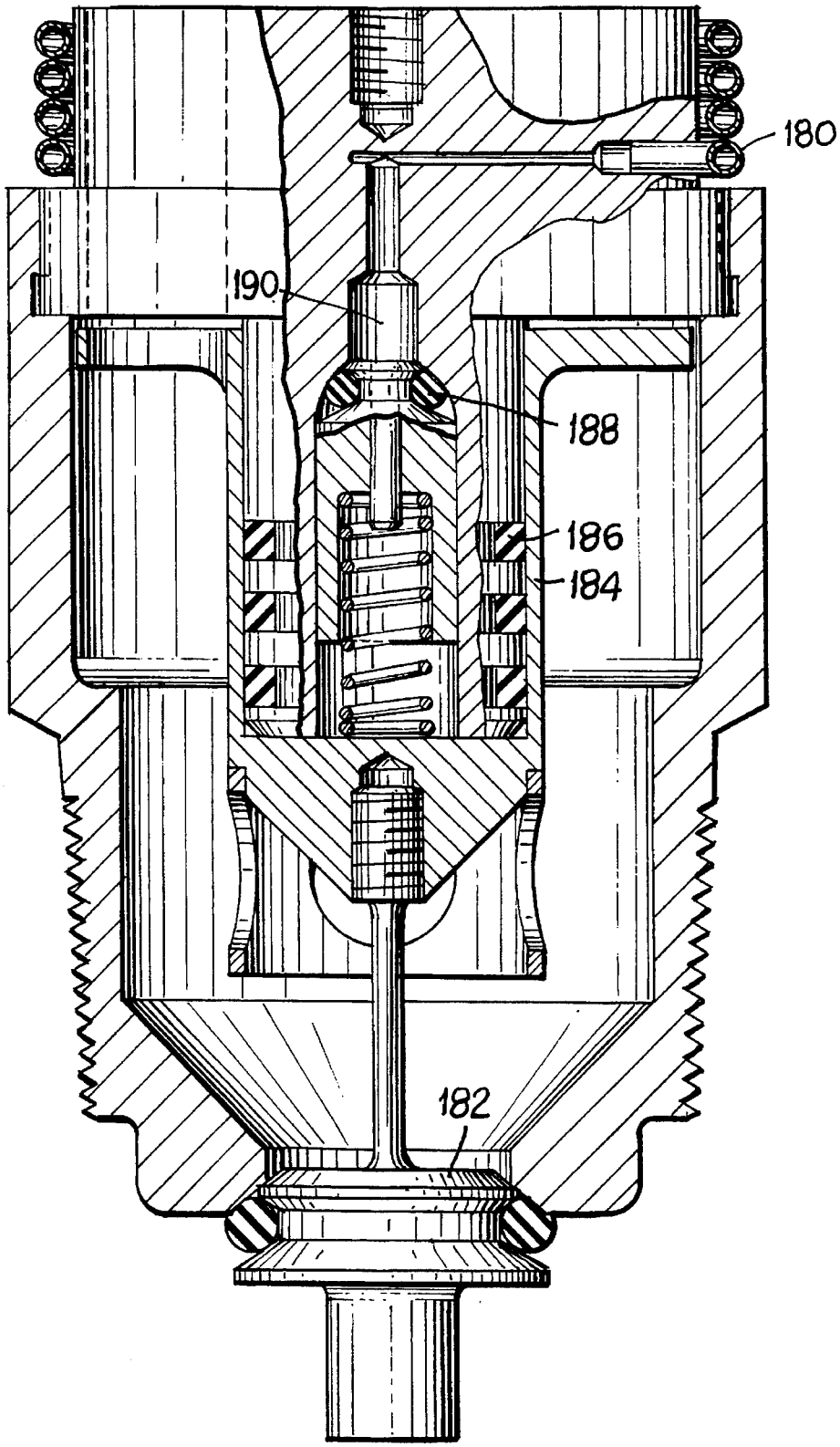
FIG. 8 is a fragmentary axial sectional view of another embodiment of the actuator contemplated herein.

In fire sprinkler applications it is desirable frequently to provide in-line valving organized to take up little ceiling height. Toward this objective hydride sensor actuator 180 was fabricated as shown in FIG. 8. Actuator 180 was fabricated from 1/16 outside diameter stainless steel tubing with 0,005" wall thickness. The function of the actuator 180 is automatically to operate a valve 182 in response to an ambient air temperature change. Details of the hydride sensor, base and expandable element are substantially similar to those shown and described for FIGS. 2, 3 and 4. Closure is provided by movement of a piston 184 as hydrogen gas pressure increases in the hydride sensor actuator. The piston 184 is sealed by means of quad rings 186.

A further feature of the embodiment of FIG. 8 resides in the inclusion of a small check valve 188 in hydrogen gas passage 190. Check valve 188 is positioned to oppose flow of hydrogen back to the hydride sensor actuator 180. A small hole (not shown) and porous plug (not shown) are inserted in the base of the check valve 188 to retard, but not prevent, return of hydrogen to the sensor actuator 180. Said arrangement provides time delay control of shutoff of a fire sprinkler. The check valve 188 shown in FIG. 8 is fitted with a Mott 5000 —⅛th inch—1 cc/min. porous flow control element. Shutoff is delayed for 72 seconds. For applications in which fast response is not required, a porous plug inserted directly into hydrogen passageway 190 provides time delay control for shutoff.

The actuator shown in FIG. 8 was connected to a 50 psig waterline. Hot air, 275° F., was directed at the temperature sensor. The flow rate of the hot air was 250 feet per minute. The actuator turned on in 6 seconds.

The disclosed details are exemplary only and are not to be taken as limitations on the invention except as those details may be included in the appended claims.

We claim:

1. An actuator for repeatedly performing a function at a predetermined temperature, said actuator comprising an actuator assembly including an expandable element comprised of a bellows having a closed end, and means outside said expandable element for reversibly liberating hydrogen gas into a sealed system defined in part by said expandable element, said means for liberating hydrogen gas comprising hydride sensor assembly including an outer tube containing tubular means porous to the passage of hydrogen gas and spaced from the inner wall of said outer tube and providing a hydrogen gas passage, and hydriding alloy powder between said outer tube and said tubular means, said outer tube having a closed sealed end and an open end in hydrogen gas communication with the interior of said bellows, so that when the temperature of said powder rises to a predetermined value, desorption of said powder suddenly liberates hydrogen gas into said hydrogen gas passage, internally pressurizing said bellows to a predetermined value, said hydrogen gas passage having a check valve and flow restrictor positioned therein to provide time delay control for shutoff of the hydride sensor.

2. An actuator in combination with a piston for repeatedly performing a function at a predetermined temperature without requiring replacement of any parts, said actuator comprising an actuator assembly including an expandable element, and means outside said expandable element for reversibly liberating hydrogen gas into a sealed system defined in part by said expandable element, whereby when the hydrogen gas pressure in said system becomes sufficiently high, said expandable element will expand to repeatedly perform said function by moving said piston and when said liberated hydrogen is recaptured, said expandable element contracts so as to return said actuator combination to its original state prior to said performance of said function, wherein expandable element is a bellows having a closed end and said means for liberating hydrogen gas is a hydride sensor assembly having a coiled portion, and including an outer tube containing tubular means porous to the passage of hydrogen gas and spaced from the inner wall of said outer tube and providing a hydrogen gas passage, and hydriding alloy powder between said outer tube and said tubular means, said outer tube having a closed sealed end and an open end in hydrogen gas communication with the interior of said bellows, so that when the temperature of said powder rises to a predetermined value, desorption of said powder suddenly liberates hydrogen gas into said hydrogen gas passage, internally pressurizing said bellows to a predetermined value, and subsequent absorption of said hydrogen by said powder causes depressurization and contraction of said bellows thereby returning said actuator combination to a condition identical to its original state prior to said performance of said function, said actuator combination further including a normally closed valve assembly having an inlet side and an outlet side, a water line for supplying water to said inlet side and a sprinkler head attached to said outlet side, said coiled portion of said hydride sensor assembly being wrapped around said sprinkler head, and said piston being positioned to open said valve assembly upon predetermined movement of said piston, thus to reversibly open said valve assembly and activate the sprinkler head.

* * * * *